US005694713A

United States Patent [19]

Paldino

[11] Patent Number: 5,694,713

[45] Date of Patent: Dec. 9, 1997

[54] HANDGUN WITH INTERNAL LASER SIGHT HAVING ELEVATIONAL ADJUSTMENT MECHANISM

[76] Inventor: Arthur Paldino, 470 Halstead Ave., Harrison, N.Y. 10528

[21] Appl. No.: 743,739

[22] Filed: Nov. 6, 1996

[51] Int. Cl.[6] ..... F41G 1/34

[52] U.S. Cl. ..... 42/103; 33/DIG. 21; 362/110

[58] Field of Search ..... 42/103; 33/254, 33/257, 259, 260, 286, DIG. 21, 241; 362/114, 113, 110

[56] References Cited

U.S. PATENT DOCUMENTS

| | | | |
|---|---|---|---|
| 4,934,086 | 6/1990 | Houde-Walter | 42/103 |
| 5,299,375 | 4/1994 | Thummel et al. | 42/103 |
| 5,323,555 | 6/1994 | Jehn | 42/103 |
| 5,355,608 | 10/1994 | Teetzel | 42/103 |
| 5,375,362 | 12/1994 | McGarry et al. | 42/103 |
| 5,388,364 | 2/1995 | Paldino | 42/103 |
| 5,419,072 | 5/1995 | Moore et al. | 42/103 |
| 5,425,299 | 6/1995 | Teetzel | 42/103 |
| 5,531,040 | 7/1996 | Moore | 42/103 |

*Primary Examiner*—Michael J. Carone
*Assistant Examiner*—Theresa M. Wesson
*Attorney, Agent, or Firm*—Martin J. Spellman, Jr.

[57] ABSTRACT

An automatic handgun with a laser sight which may be adjusted in elevation is disclosed. A laser beam source and mechanism for adjusting the elevation are all contained within the guide rod chamber. At the front of the guide rod cylinder an adjusting ring is turned clockwise or counter-clockwise to rotate a slotted cylinder having a spiraled slot therein in which rides a finger of a cam rod. The cam rod is moved forward or backward to move a cradle to tilt a yoke holding an optical prism through which the laser beam passes. The beam is bent depending upon the tilt of the prism. The automatic handgun is thus provided with a laser sight that may be adjusted for elevation and all of the components of the sight are contained internally of the handgun within the slide return chamber.

1 Claim, 4 Drawing Sheets

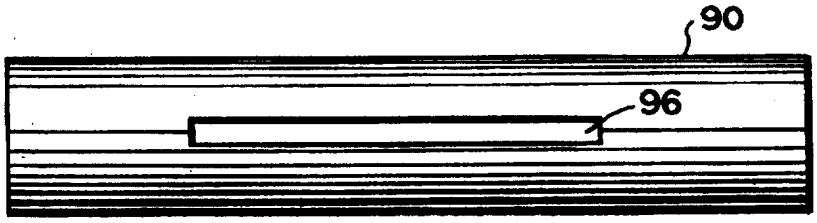
FIG.5
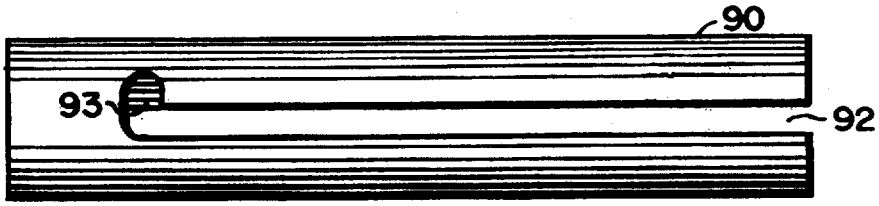
FIG.6
FIG.7
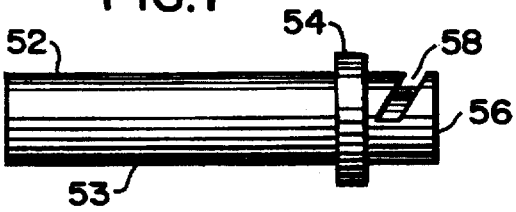
FIG.8
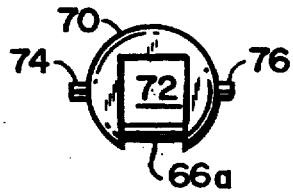
FIG.9
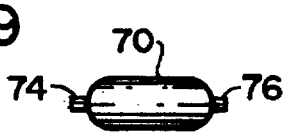
FIG.10
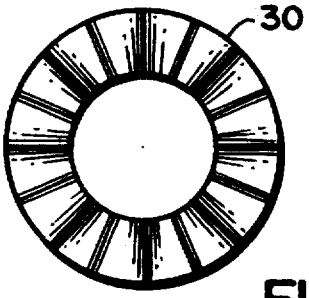
FIG.11
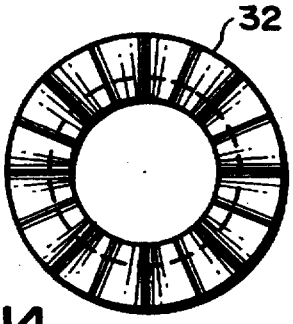
FIG.12
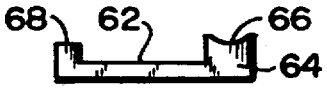
FIG.13
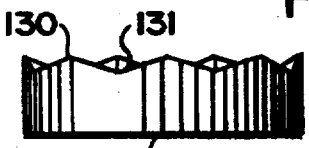
FIG.14
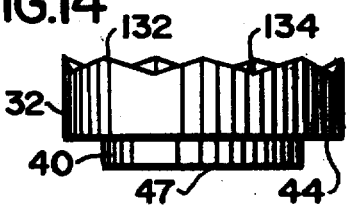

HANDGUN WITH INTERNAL LASER SIGHT HAVING ELEVATIONAL ADJUSTMENT MECHANISM

BACKGROUND OF THE INVENTION

This invention relates to sights for automatic handguns and in particular to internally mounted laser sights in handguns. This present application is more specifically concerned with an internally mounted laser sight for handguns that is provided with an elevational adjustment that is readily operated externally of the handgun.

This invention is concerned with automatic hand guns, in particular for a laser operated sighting system for an automatic handgun. The lasers are contained in the recoil guide rod of the gun which also incorporates the return spring. It is more particularly concerned with the laser sight which is capable of being adjusted externally in a facile manner for elevation through means of an adjustable optical prism which will bend the laser beam that emanates from the laser light source.

In recent years there has been significant development in laser mounted sights for automatic handguns. Most sights that have been available are externally mounted on the handgun.

The utilization of laser beams for sights in hand held firearms or weapons is a relatively recent development. The laser sighting systems were bulky and utilized in the form of add-on's to weapons, often simply attached in a manner parallel to the barrel. They were very awkward and bulky in appearance and use.

Aside from being complex, the structure and electronics of the existing systems are capable of "spotting" the target, allowing the shooter to obtain much better sighting results than the usual mechanical sights.

Applicant previously devised a mechanism for internally mounting a laser sight within an automatic or semi-automatic handgun exemplified by prior issued U.S. Pat. No. 5,388,364. It is desirable for increased flexibility and greater accuracy in aiming a handgun over variable and longer distances that the laser sights be adjustable, especially for elevation.

In cases of more recently developed laser sights, arrangements which are internally mounted in the recoil guide rod, the possibility of adjusting the sight for elevation was made more complicated because the sight and the battery components were all internal to the gun and no conventional external sighting adjustments were suitably adaptable to the elevation adjustment of the internally mounted laser sight.

Applicant is not aware of any prior art which has provided a totally internally mounted laser sight on automatic handguns, much less one which can be readily adjusted externally for elevation of the weapon.

In accordance therewith, the present invention provides a compact, relatively low cost, neat, easily operated, finely tuned, accurate mechanism for adjusting a laser sight for elevation, achieving precise accuracy at varying distances and the shooter does not have to make an on the spot estimated adjustment in aim for elevation but can adjust for changes due to distances or individual characteristics of the weapon or ammunition being utilized. Such adjustments have not been possible previously, particularly for internally mounted laser sights without the use of hand tools such as a screwdriver. Crude known methods have been utilized for making rough adjustments on externally mounted sights.

SUMMARY OF THE INVENTION

In accordance with the present invention there is provided an internally mounted laser sight for an automatic handgun. In addition to providing an internally mounted laser sight, the laser sight can be adjusted for elevation from the exterior of the gun.

The laser sight of the present invention is securely mounted internally of the gun and the external adjustment to the internally mounted sight is of a very rugged construction. It does not disturb the mounting of the laser beam itself, but redirects the laser beam appropriately in elevation by refracting the laser beam through a prism which is tilted in order to bend the beam sightly up or down to adjust for the elevation.

In accordance with the present invention the recoil spring in the weapon is retained. The recoil guide rod in accordance with my prior patent contains the laser beam component between the spring and the end of the slide.

The present application is not concerned with the electronics, batteries or the on/off switch which powers the laser beam itself, but is concerned, as indicated above, primarily with a means for adjusting the laser beam for elevation.

Accordingly, an optical prism such as a dove prism or gradient index lens, or wedge prism is placed in the external end of the recoil guide rod mounted within a tiltable yoke. The yoke which is tiltable is mounted within a cylinder. It is tiltable about a transverse axis. The yoke has pivot pins mounted opposite each other in a horizontal plane. The pins are mounted in the base of a pair of horizontal slots in a cylindrical sleeve at the rear of the adjustable portion of the sight.

A base connecting bar for the yoke which is moveable is mounted under the yoke and is moveable forward and aft to cause the yoke carrying the prism to tilt forward and backward and thus cause the prism to tilt upward or downward. Since the arrangement is mounted forward of the laser beam source, movement of the prism will cause the laser beam to tilt upward or downward. The movement of the yoke is effectuated by turning an adjusting ring which has a spiral slot engaging an upwardly extending cam pin of the connecting bar.

The inner cylinder has a bushing to retain the compression spring. The adjustable sight of the present invention fits in the guide rod in front of the laser beam source which is connected in accordance with circuitry disclosed in my prior patent. Forward thereof, on the inner face of the external adjustment ring and on the outer face of the inner cylinder, a pair of intermeshing surfaces, one of which is adjustable are installed, the outer one thereof being finger adjustable by the user. An optical window covers the outer end.

The adjusting ring moves a cam rod forward or backward within the cylindrical housing. An upwardly extending cradle at the inner end of the connecting bar is connected to or seated in the yoke on which is mounted the prism through which the laser beam passes. The prism causes the laser beam to be bent upwardly or downwardly, as the case may be, depending upon whether the external adjustment ring is turned clockwise or counter-clockwise, respectively, to tilt the prism.

The radial movement is translated to longitudinal movement by a pin riding in a spiral slot within the central cylinder which is rotated. This moves the connecting bar forward or back, and consequently the lower portion of the yoke mounting is also moved forward or backward to, in turn, tilt the prism to adjust the laser beam up or down as required for sighting accuracy.

BRIEF DESCRIPTION OF THE DRAWING

Referring to the accompanying drawing which form a part of the specification:

FIG. 5 is plan view taken along lines 5—5 of FIG. 4;

FIG. 6 is a plan view taken along lines 6—6 of FIG. 4;

FIG. 7 is a side plan view taken along lines 7—7 of FIG. 4;

FIG. 8 is a front plan view of the prism yoke shown in FIGS. 2, 3, and 4 and clearly should indicate the prism in that;

FIG. 9 is a bottom plan view taken along lines 9—9 of FIG. 4 showing the yoke;

FIG. 10 is a plan view taken along the lines 10—10 of FIG. 4 and showing the front of the adjusting ring;

FIG. 11 is a front plan view taken along the lines 11—11 of FIG. 4;

FIG. 12 is the side plan view of the connecting bar;

FIG. 13 is the side plan view of the adjustment ring of FIG. 10 and

FIG. 14 is the side plan view of the bushing of FIG. 11.

ILLUSTRATIVE SPECIFIC EMBODIMENT

Figure 1:
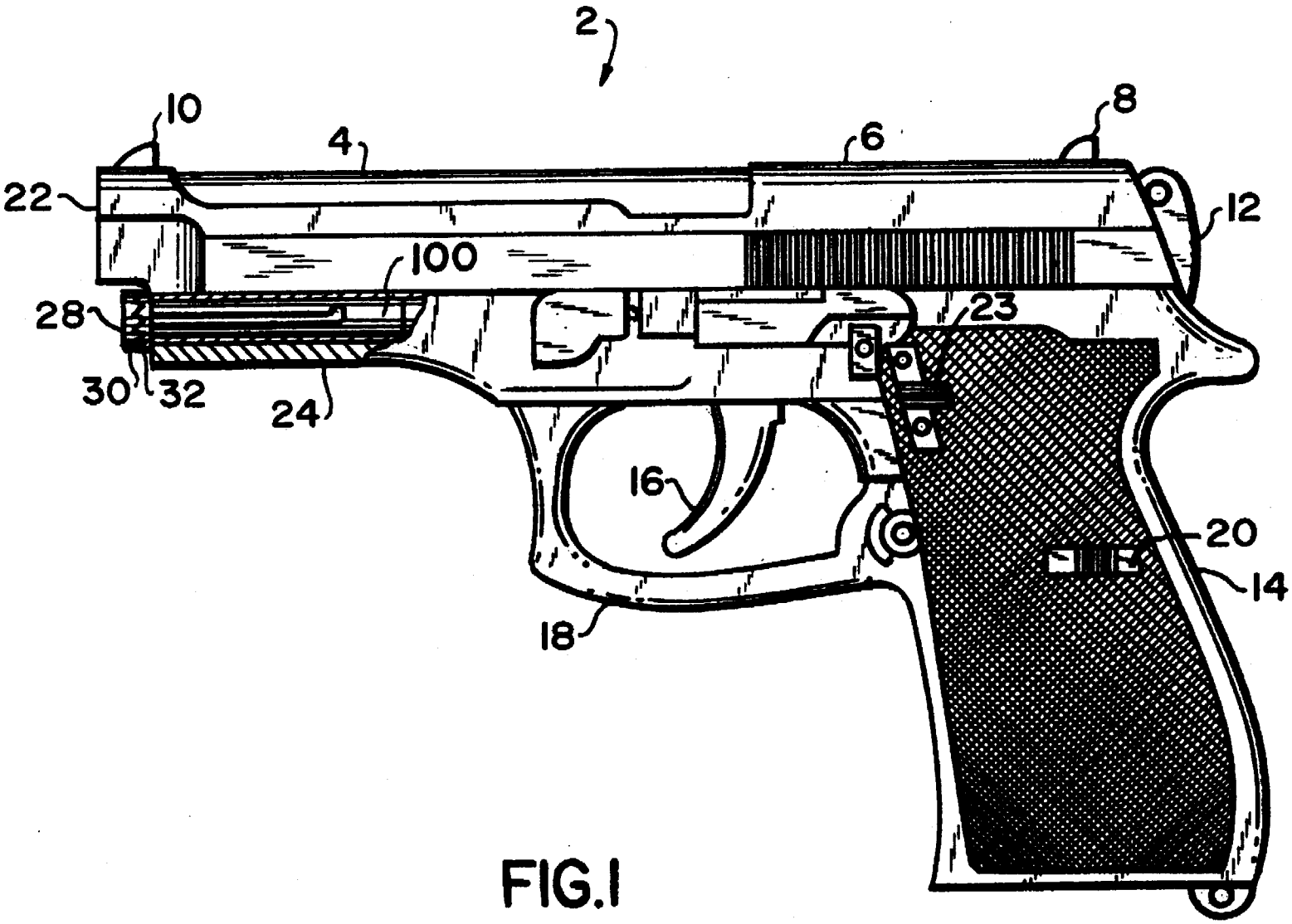
FIG. 1 is a side plan view, partially cut away in the slide area of an automatic handgun incorporating the adjustable laser sight of the present invention.

Referring to the accompanying drawing, an automatic handgun incorporating the adjustable laser sight of the present invention is shown generally at 2 in FIG. 1 and includes a barrel 4, top slide and frame 6, rear mechanical sight 8, front mechanical sight 10, hammer 12, handle 14, trigger 16, and trigger guard 18.

An on/off switch is indicated 23 and battery selection switch at 20 and muzzle at 22.

The standard recoil guide rod has been replaced with a laser recoil guide rod 100 incorporating structures according to the present invention.

An optical window 28 at the front of the laser guide rod 100 allows for transmission of the laser beam 36 and seals the mechanism.

The two discs, adjusting ring 30 which is press fitted onto the forward end of center slotted cylinder 52 creating a bezel 34 for optical window 28, and annular bushing 32 are axially mounted with respect to each other as shown.

The adjusting ring 30 controls the up and down movement of the sight laser beam 36, and therefore the sight, by rotating cylinder 52 with the spiral groove 58 at its end portion 56. Rotating adjusting ring 30 clockwise or counter-clockwise respectively thus tilts the prism 80 to redirect/bend the laser beam 38.

Figure 2:
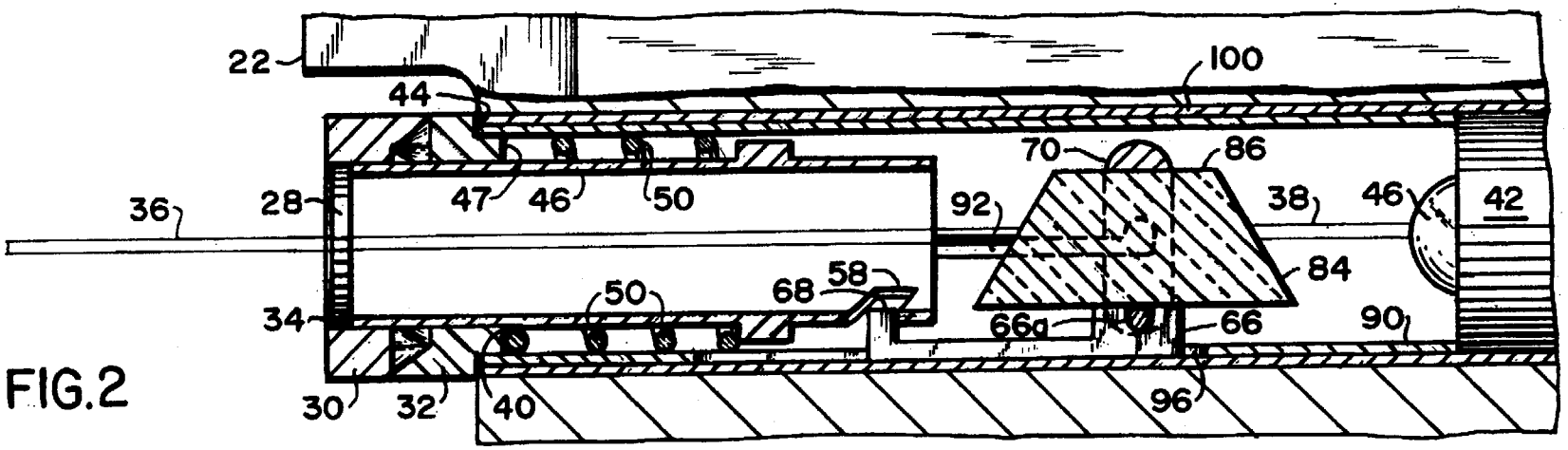
FIG. 2 is an enlarged side sectional view of the cut-away section of the slide area shown in FIG. 1.
Figure 3:
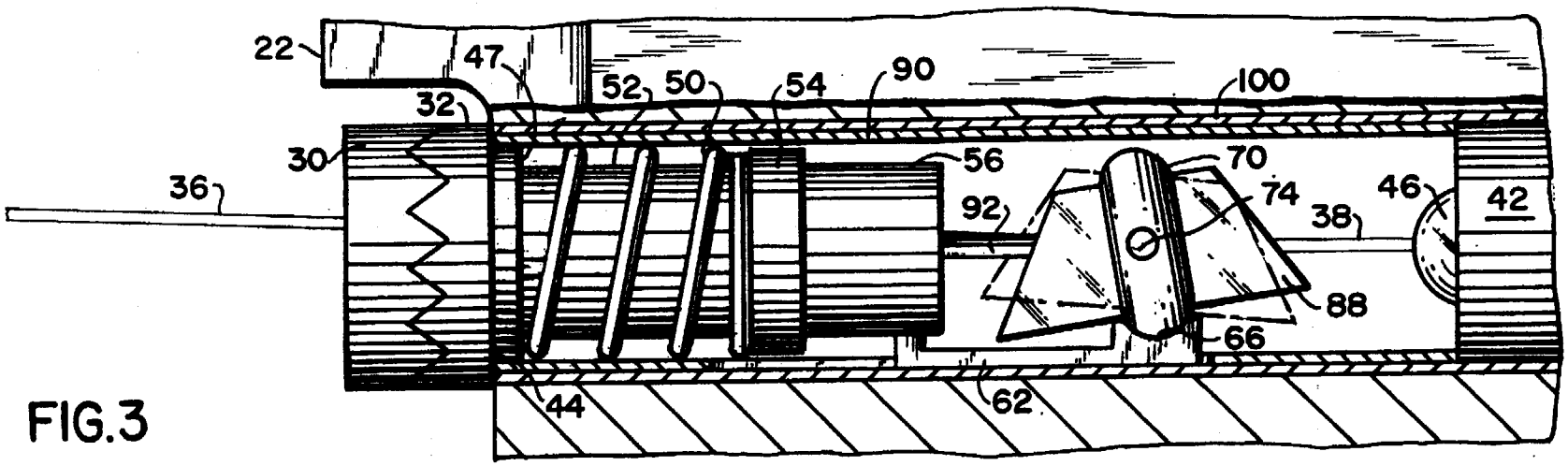
FIG. 3 is an enlarged plan view of the components of the laser sight, partially in section, as mounted in FIG. 2.
Figure 4:
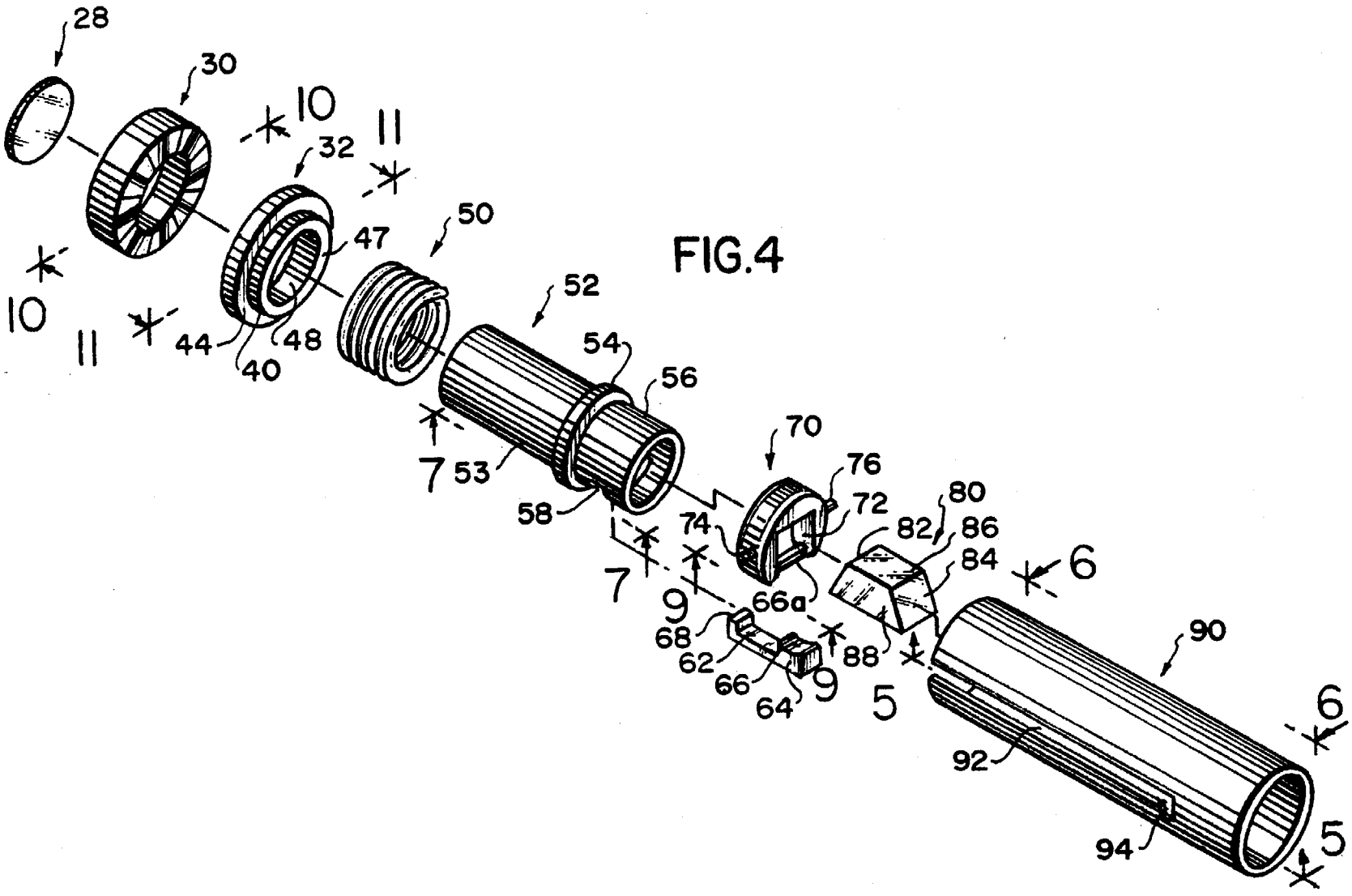
FIG. 4 is an exploded view of the components shown in FIGS. 2 and 3.

The interior of the adjustment mechanism is shown in more detail in FIGS. 2 and 3.

The source laser beam 38 is projected from the laser emitting diode 46 contained in the laser tube 42, as in my previous patent.

The annular bushing 32 has a rearwardly projecting annular shoulder 40 from the annular surface or face 44, and has an annular central opening 48 through which cylinder 52 passes, enabling cylinder 52 to rotate freely.

The front ends of recoil guide rod 100 and of cylindrical housing 90 bear on face 44.

The compression spring 50 bears on the ledge surface 47 and over the outer wall of cylinder 52 outwardly of ridge 40 and rests against ledge 47, goes over the outer wall 53 of the cylinder 52 and at its rear end and rests against the annular bushing 54 on cylinder 52.

The rear end portion 56 of the cammed inner cylinder 52 has the spiraled groove 58 formed therein. The upwardly extending cam pin 68 of the connecting rod 62 rides in the groove 58.

The rear portion 64 of the connecting rod 62 supports the bottom of the yoke 70 which has pivot pins 74 and 76 which rest in the detents 93 and 94 of the two slots, 92, one on each side of cylindrical housing 90.

Connecting rod 62 rides in track 96 of cylindrical housing 90 limiting its movement to fore and aft only. Cradle 66 inserts into keyway 66A to prevent yoke 70 from rotating. It rides in the longitudinal slot 96 of the cylindrical housing 90 so that cradle 66 will tilt the prism 80, which is press fitted into rectangular aperture 72 of yoke 70, when it, the cradle 66 moves forward or backward.

The prism 80, has a top 86, bottom 88 and sides 82 and 84.

Referring to FIGS. 13 and 14, adjusting ring 30 has the raised portions 130 and depressions 131, and the bushing 32 has the raised portions 132 and depressed portions 134 with the interlocking highs and lows preventing unwanted slippage between ring 30 and bushing 32.

The interlocking surfaces formed by the portions 130 and 131 on the rear face of adjusting ring 30 that mesh with the portions 132 and 134 on the face of bushing 32 assure that the center slotted cylinder 52 does not turn if it is not so intended. The movement of adjusting ring 30 compresses spring 50 against the surfaces 47 and 54 allowing the connecting rod 62 to move forward or backward by movement of the cam pin 68 riding in the spiraled grove 58 of cylinder 52.

The movement of the connecting rod 62 moves the cradle 66 which tilts the yoke 70 and thus the prism 80, causing the bending of laser beam 38 as indicated by exit beam 36.

Thus there has been provided a laser sight which is contained entirely internally of an automatic hand gun and readily may be adjusted for elevation by simply turning the adjusting ring 30 clockwise or counter-clockwise.

Thus there has been provided a horizontally adjustable laser beam sight mechanism mounted completely internally of the weapon and is adjustable for elevation simply by rotating an adjusting ring at the outer end of the recoil guide rod assembly.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A laser beam sight adjusting system in an automatic handgun having a laser beam source mounted in a recoil guide rod of said handgun comprising:

an adjusting ring at the outer end of said guide rod, a rear face of said adjusting ring engaging a cylindrical rotatable shaft, said rotatable shaft having a spiralled groove formed therein toward the rear thereof, a finger of a connecting rod engaging in said groove so that when said cylindrical shaft is rotated said finger is moved forward or backward by said spiralled groove, a cradle on an upper surface at the rear of said connecting rod, a pivoted yoke carried on said cradle, an aperture in said yoke, a prism mounted in said aperture of said yoke, said laser beam passing through said prism, and whereby said laser beam may be bent upwardly or downwardly by turning said adjusting ring clockwise or counter-clockwise to turn said cylindrical shaft to move said rod and said cradle to tilt said yoke and thereby said prism.

* * * * *